US007621022B2

(12) United States Patent
Gandevia et al.

(10) Patent No.: US 7,621,022 B2
(45) Date of Patent: Nov. 24, 2009

(54) PLASTIC TOP HINGE FOR REFRIGERATOR

(75) Inventors: Jimmy C. Gandevia, Evansville, IN (US); Kenneth J. Rasche, Evansville, IN (US); Steven E. Tolliver, Newburg, IN (US); Brian K. Culley, Mt. Vernon, IN (US); Daryl L. Reuter, Evansville, IN (US); Matthew W. Burdette, Oakland City, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 289 days.

(21) Appl. No.: 11/350,150

(22) Filed: Feb. 8, 2006

(65) Prior Publication Data

US 2007/0180655 A1 Aug. 9, 2007

(51) Int. Cl.
*E05D 5/00* (2006.01)

(52) U.S. Cl. ..... 16/385; 16/225; 16/387; 16/386; 16/250; 16/DIG. 13

(58) Field of Classification Search ..... 16/265, 16/DIG. 43, 268, 226, DIG. 13, 386, 309, 16/225, 385, 387, 250; 312/405, 405.1, 326; D8/323

See application file for complete search history.

(56) References Cited

U.S. PATENT DOCUMENTS 1,529,646 A * 3/1925 Aldeen ..... 16/374
3,675,271 A * 7/1972 Fellwock et al. ..... 16/265
3,703,742 A 11/1972 Konishi ..... 16/128
4,545,090 A 10/1985 Redmond ..... 16/385
4,574,425 A 3/1986 Suguira ..... 16/225
5,020,189 A * 6/1991 Grome et al. ..... 16/286
5,187,837 A * 2/1993 Gunderson et al. ..... 16/375
5,369,842 A * 12/1994 Beatty ..... 16/317
5,885,691 A * 3/1999 Breezer et al. ..... 428/156
6,058,566 A * 5/2000 Kerr et al. ..... 16/387
6,070,294 A * 6/2000 Perkins et al. ..... 16/252
7,065,832 B2 * 6/2006 Pohl ..... 16/235

* cited by examiner

*Primary Examiner*—Victor Batson
*Assistant Examiner*—Jeffrey O'Brien
(74) *Attorney, Agent, or Firm*—Kirk W. Goodwin; Greer, Burns & Crain Ltd.

(57) ABSTRACT

A top hinge is provided for a refrigerator cabinet door. A hinge body is formed of plastic having a top surface and a bottom surface. A hinge pin extends substantially perpendicularly from the bottom surface of the hinge body. One or more points of attachment are formed on the hinge body. An axis of twist passes through a center of the hinge pin and an effective center of attachment. At least a first rib and a second rib extend from the bottom surface of the hinge body. The ribs extend along a length of the bottom surface at an oblique angle relative to the axis of twist and diverge from each other by an angle of at least about 60 degrees.

20 Claims, 5 Drawing Sheets

PLASTIC TOP HINGE FOR REFRIGERATOR

BACKGROUND OF THE INVENTION

The present invention relates generally to a hinge for a refrigerator and particularly a plastic top hinge for a refrigerator cabinet door.

In refrigerator cabinets, a hinge is provided to allow the cabinet door to swing open. Typically, there is a bottom hinge with an upwardly projecting hinge pin (see U.S. Pat. No. 5,369,842) and a top hinge with a hinge pin projecting downwardly from a hinge body, with the door pivoting on these two hinge pins. The bottom hinge supports most of the vertical load, or weight of the door, and the top hinge, in addition to providing the upper point of rotation, must support loads associated with the fact that the door is mounted in a cantilevered manner, so there are side loads on the hinge pin which act to bend and twist the hinge body. In the past, it has been common to use a metal hinge plate and hinge pin, to provide the strength necessary to support the load imposed by the door, and objects carried in the door, or users pulling downwardly on the door. For aesthetic purposes, a plastic cover was mounted over the hinge pin, for example with threaded fasteners.

It would be an improvement in the art if a top hinge were provided for a refrigerator that would reduce the cost, weight and assembly steps involved in presently available refrigerator door hinges.

SUMMARY OF THE INVENTION

The present invention, in an embodiment, provides a top hinge for a refrigerator cabinet door. The hinge includes a hinge body formed of plastic having a top surface and a bottom surface, a hinge pin extending substantially perpendicularly from the bottom surface of the hinge body, and one or more points of attachment formed on the hinge body, the points of attachment defining a geometric center of attachment spaced from the hinge pin. An axis of twist passes through a center of the hinge pin and the center of attachment, and at least a first rib and a second rib extend substantially perpendicularly from the bottom surface of the hinge body. The ribs extend along a length of the bottom surface at an oblique angle relative to the axis of twist and diverge from each other by an angle of at least about 60 degrees.

In an embodiment, both of the ribs extend through the axis of twist.

In an embodiment, the oblique angle is between about 30 to 60 degrees.

In an embodiment, the oblique angle is approximately 45 degrees.

In an embodiment, a perimeter wall extends from the bottom surface.

In an embodiment, the perimeter wall extends substantially around an entire perimeter of the hinge body.

In an embodiment, the perimeter wall extends substantially perpendicular from the bottom surface.

In an embodiment, the perimeter wall extends from the bottom surface and flush with an outer edge of the hinge body.

In an embodiment, the plurality of ribs extend along the bottom surface and engage at least at one end with the perimeter wall.

In an embodiment, the hinge body is formed of molded plastic and the hinge pin and ribs are molded integrally and simultaneously with the hinge body.

In an embodiment, the at least one point of attachment comprises at least one fastener opening through the hinge body.

In an embodiment, the fastener opening includes a boss surrounding the opening and extending from the bottom surface.

In an embodiment, the fastener opening includes a recess for receiving a head of a threaded fastener.

In an embodiment, the fastener opening comprises three fastener openings.

In an embodiment, the first rib extends from the bottom surface for a first height and the second rib extends from the bottom surface for a second, greater height.

In an embodiment, the rib with the first height is arranged at a portion of the hinge body including the hinge pin and the rib with the second height is arranged at a portion of the hinge body including the center of attachment.

In an embodiment, a longitudinal rib extends parallel to the axis of twist.

In an embodiment, a lateral rib extends perpendicular to the axis of twist.

In an embodiment, the hinge pin contains a blind hole oriented along an axis of the pin.

These and other aspects and details of the present invention will become apparent upon a reading of the detailed description and a review of the accompanying drawings. Specific embodiments of the present invention are described herein. The present invention is not intended to be limited to only these embodiments. Changes and modifications can be made to the described embodiments and yet fall within the scope of the present invention.

DETAILED DESCRIPTION OF THE PREFERRED EMBODIMENTS

Figure 1:
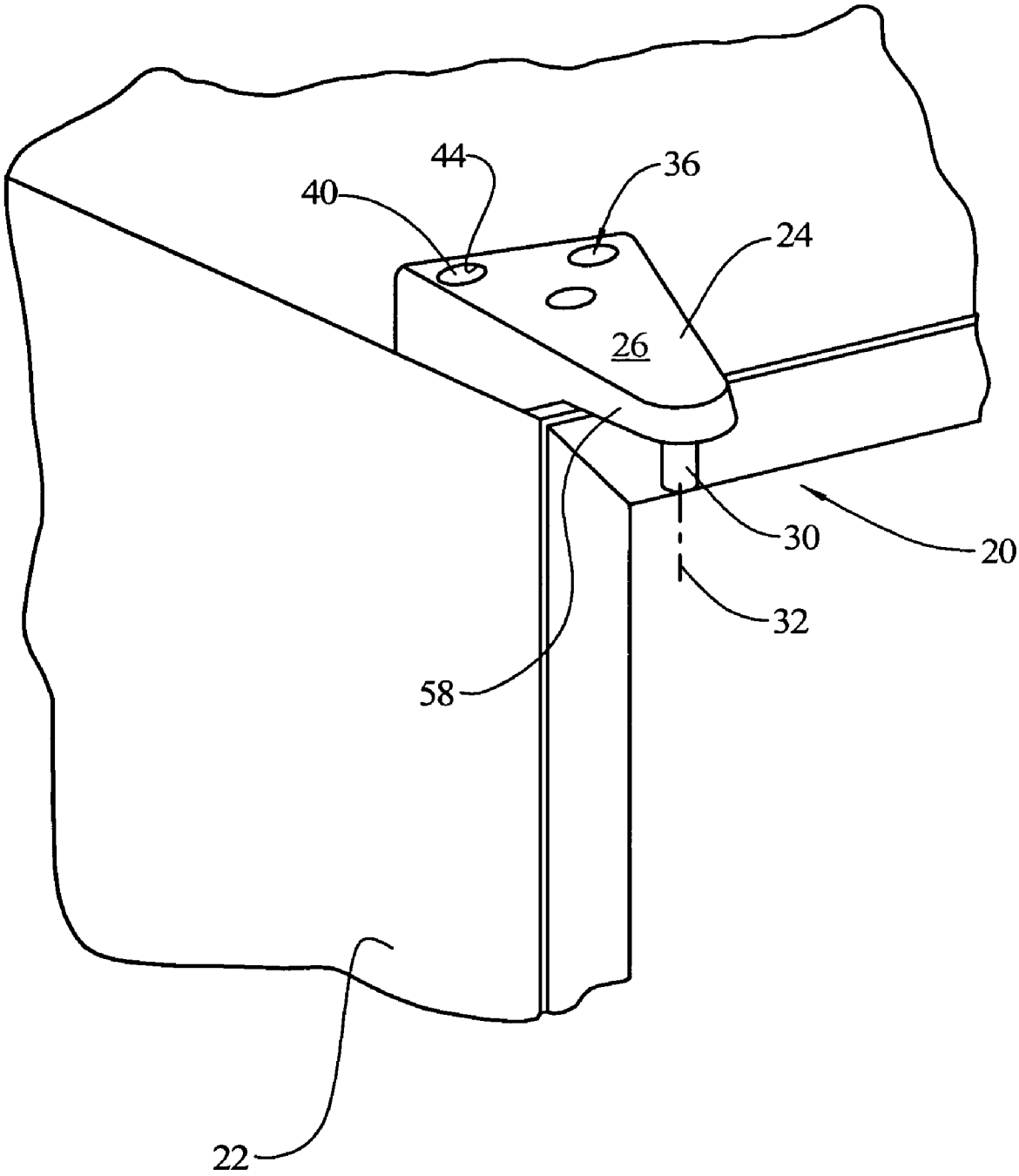
FIG. 1 is a partial front perspective view of a refrigerator cabinet in the area of the top hinge for the door, with the door removed for clarity.

As illustrated in FIG. 1, the present invention, in an embodiment, provides a top hinge 20 for a door (not shown) of a refrigerator cabinet 22. The hinge 20 may be used in various environments, such as for a full width door, a side-be-side door, a short door, as in a top mount freezer compartment door of a combination refrigerator/freezer or the refrigerator door in a bottom mount combination refrigerator/freezer, or a full height door for a refrigerator or freezer. As shown in greater detail in FIGS. 2-7, the hinge 20 includes a hinge body 24 formed of plastic having a top surface 26 and a bottom surface 28. Various types of plastics could be used for the hinge, such as PBT polybutylene terephthalate and glass reinforced plastic, depending on the load being carried by the hinge. The plastic hinge body 24 may be molded, extruded, or formed in other manners, including being machined.

A hinge pin 30 extends substantially perpendicularly from the bottom surface 28 of the hinge body 24. The hinge pin 30 defines an axis of door rotation 32 (FIG. 1) which is colinear with an axis 34 (FIG. 4) of the hinge pin. One or more points of attachment 36, here illustrated as three points forming the vertices of a triangle, are formed on the hinge body 24. The points of attachment 36 define a geometric center of attachment 38 (FIG. 3) which is spaced from the hinge pin 30. The geometric center of attachment 38 for a single point of attachment 36 would be at the exact point of the attachment and the geometric center of attachment for two points of attachment would be a point exactly halfway between the two points. For three or more points of attachment 36, a geometric center can be determined using known principles of geometry. If more than 3 points of attachment are provided, only those points of attachment that provide effective attachment for the hinge body should be used in determining the center of attachment, termed the effective center of attachment, since the provision of superfluous points of attachment will not change the effective center of attachment.

In an embodiment, each point of attachment 36 may be a fastener opening 40 through the hinge body 24. Thus, when there are three points of attachment 36, there will be three fastener openings, as illustrated in the drawings. The fastener opening 40 may include a boss 42 surrounding the opening and extending from the bottom surface 28. The fastener opening 40 may include a recess 44 (FIGS. 6 and 7) for receiving a head of a threaded fastener, so that the fastener will not be visible once the hinge body 24 is attached to the refrigerator cabinet 22.

An axis of twist 50 passes through a center 52 of the hinge pin 30 and the effective center of attachment 38. The weight of the door acting at the center of gravity causes a lateral force to act on the pin 30. The lateral force will be transmitted to the hinge body 24 causing it to twist about the axis of twist 50. In order to prevent excessive twisting, and damage to the hinge body 24, at least a first rib 54 and a second rib 56 extend from the bottom surface 28 of the hinge body. The ribs 54, 56 extend along a length of the bottom surface 28 at an oblique angle A relative to the axis of twist 50, with one of the ribs 54 being oblique to one side of the axis of twist while the other rib 56 is oblique to the other side of the axis of twist. The term oblique is used herein to mean that the ribs 54, 56 do not extend parallel or perpendicular to the axis of twist 50. In an embodiment, the oblique angle A, which is meant to be the smallest angle between the rib 54, 56 and the axis of twist 50 is between about 30 to 60 degrees. In another embodiment, the oblique angle A is approximately 45 degrees. In an embodiment, the ribs 54, 56 may extend at not only opposite, but equal angles A relative to the axis of twist 50, and in other embodiments, oblique angles may be opposite, but not equal, such that the angle A for the ribs 54 may differ from the angle A for the ribs 56. In an embodiment, the ribs 54, 56 may extend substantially perpendicularly from the bottom surface 28.

Figure 2:
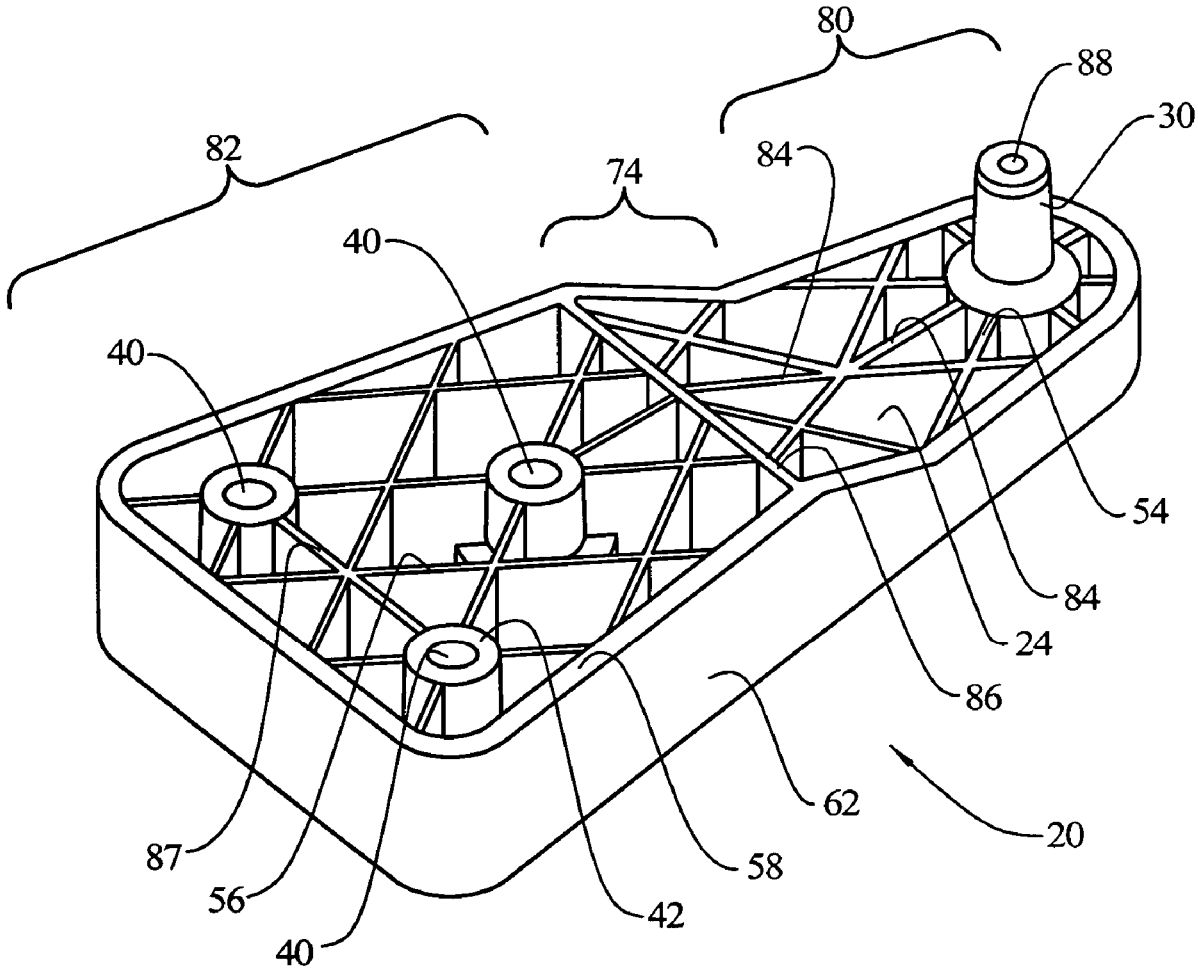
FIG. 2 is a bottom perspective view of the door hinge of FIG. 1.
Figure 3:
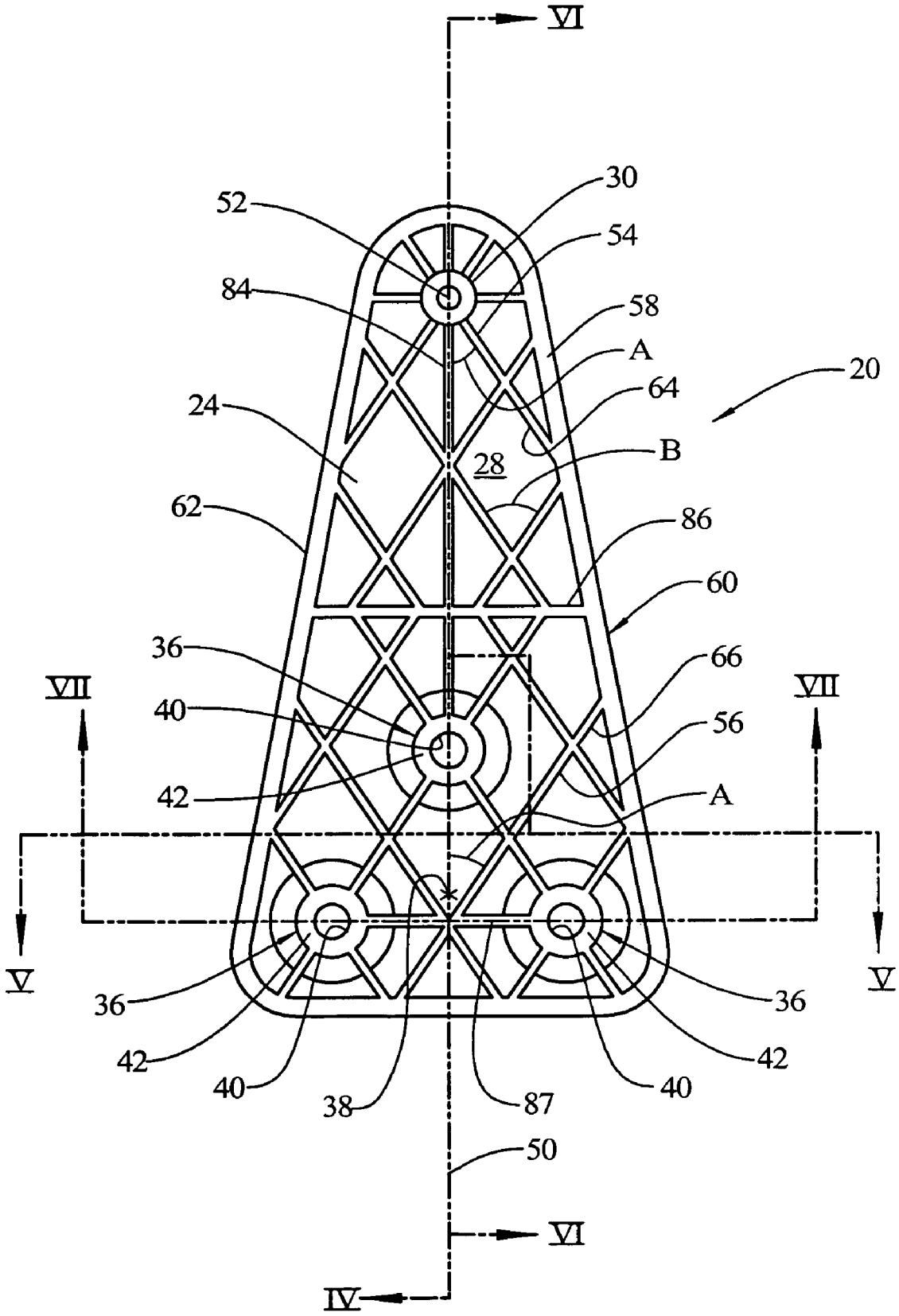
FIG. 3 is a bottom elevational view of the door hinge of FIG. 2.
Figure 4:
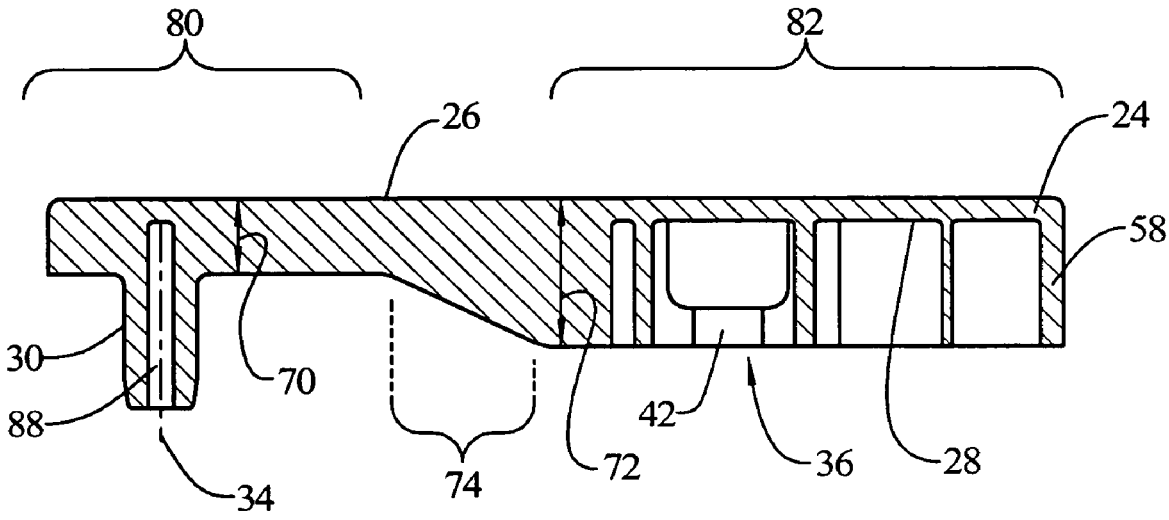
FIG. 4 is a sectional view of the door hinge taken generally along the line IV-IV in FIG. 2.
Figure 5:
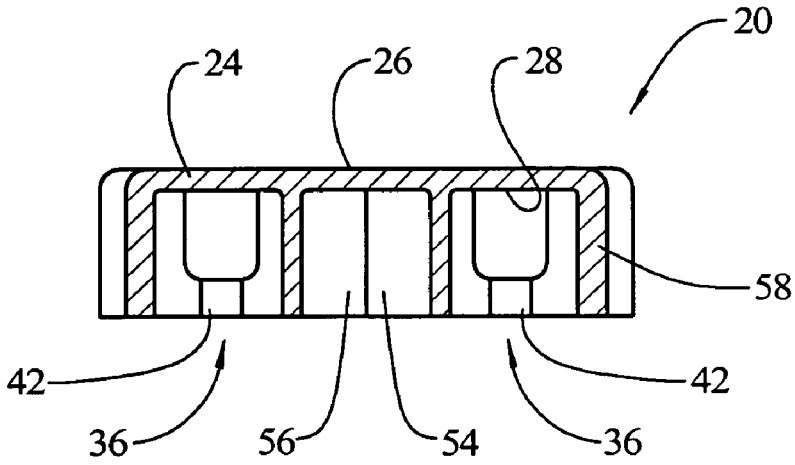
FIG. 5 is a sectional view of the door hinge taken generally along the line V-V in FIG. 2.
Figure 6:
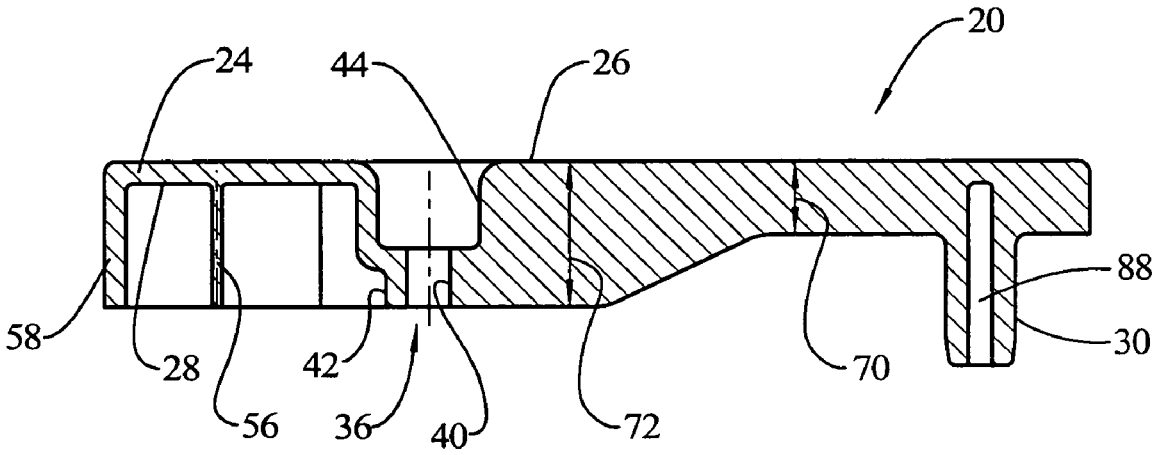
FIG. 6 is a sectional view of the door hinge taken generally along the line VI-VI in FIG. 2.
Figure 7:
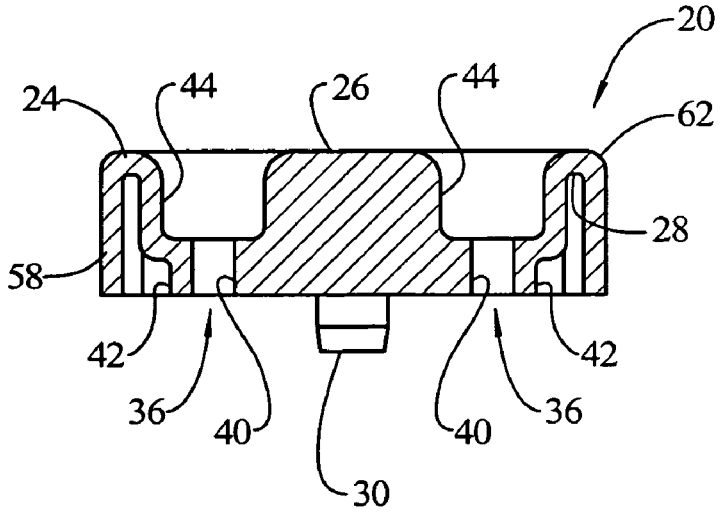
FIG. 7 is a sectional view of the door hinge taken generally along the line VII-VII in FIG. 2.

Also, in an embodiment, the ribs 54, 56 diverge from each other by an angle B, as measured as the included angle between the ribs which passes through the axis of twist 50 of between about 60 degrees and 120 degrees. In some arrangements, this means that the ribs 54, 56 actually extend through one another thereby crossing each other, such as illustrated in FIGS. 2 and 3. In some embodiments, where both ribs 54, 56 are oblique to the axis of twist 50 by the same angle A, then angle B is twice angle A. In other embodiments, where the two ribs 54, 56 are oblique to the axis of twist 50 by differing angles A, then angle B is not the sum of the two oblique angles. Also, in some arrangements, both of the ribs 54, 56 extend through the axis of twist 50, while in other arrangements, the oppositely obliquely angled ribs 54, 56 do not extend through, or cross the axis of twist.

The oblique arrangement of the ribs 54, 56 relative to the axis of twist 50, rather than having the ribs arranged parallel and perpendicular to the axis of twist, results in one of the ribs being in compression and one of the ribs being in tension, and causing the shear forces carried by the ribs to cancel each other out. This significantly reduces the actual twisting that occurs with the hinge body 24, thereby allowing less material to be used for the hinge body and resulting in a lower cost and weight.

In various embodiments, more than one first rib 54 and one second rib 56 may be provided. When more than one rib 54, 56 of each orientation is provided, in some embodiments, the ribs of each orientation are arranged parallel to each other. In some embodiments, some of the ribs 54, 56 cross more than one other rib.

In an embodiment, a perimeter wall 58 extends from the bottom surface 28. The perimeter wall 58 may extend substantially around an entire perimeter 60 of the hinge body 24, or at least a portion of the perimeter. The perimeter wall 58 may extend substantially perpendicular from the bottom surface 24. The perimeter wall 58 may be flush with an outer edge 62 of the hinge body 24. In an embodiment, the plurality of ribs 54, 56 extend along the bottom surface 28 and engage at least at one end 64, 66 with the perimeter wall 58.

In an embodiment, the first rib 54 extends from the bottom surface 28 for a first height 70 and the second rib 56 extends from the bottom surface 28 for a second, greater height 72. A transition zone 74 is provided between the two heights 70, 72 in which the height of the ribs in that zone gradually changes.

In an embodiment, the first rib 54 with the first height 70 is arranged at a portion or area 80 of the hinge body 24 including the hinge pin 30 and the second rib 56 with the second height 72 is arranged at a portion or area 82 of the hinge body including the center of attachment 36. The provision of the different heights 70, 72 allows for the refrigerator door to swing freely on the hinge 20 and to prevent any friction or binding between the top of the door and the bottom of the hinge. Various dimensional changes can be made in the heights to accommodate the particular installation requirements.

In an embodiment, a longitudinal rib 84 extending perpendicularly from the bottom surface 28 may extend parallel to the axis of twist 50. The longitudinal rib 84 may also lie colinear with the axis of twist 50. More than one such longitudinal rib 84 may be provided on the hinge body 24 to accommodate particular hinge configurations. Such longitudinal ribs may assist in opposing bending forces when the refrigerator cabinet door is opened and some component of the force on the hinge pin 30 is parallel to the axis of twist 50.

In an embodiment, a lateral rib 86 extending perpendicularly from the bottom surface 28 may extend perpendicular to the axis of twist 50. The lateral rib 86 maybe positioned to lie coincident with one end or both ends of the transition zone 74, or may be positioned at other locations on the hinge body as needed or desired. More than one such lateral rib 86 may be provided on the hinge body 24 to accommodate particular binge configurations. For example, a lateral rib 87 may be provided to extend from one fastener opening boss 42 to another as shown in FIG. 3.

In an embodiment, the hinge pin 30 contains a blind hole 88 (FIGS. 4 and 6) oriented along the axis 34 of the pin. In arrangements where the hinge pin 30 is a molded part, and is molded integrally and simultaneously with the hinge body 24, the provision of the blind hole 88 assists in the reduction of surface imperfections, such as dimpling on the top surface 26 above the location of the pin caused by shrinkage of the plastic as it cools to solid form from liquid form. The hinge pin 30 may also be hollow and open at both ends in some embodiments, or completely solid in others.

The present invention has been described utilizing particular embodiments. As will be evident to those skilled in the art, changes and modifications may be made to the disclosed embodiments and yet fall within the scope of the present invention. For example, various components could be utilized separately or independently in some embodiments without using all of the other components in the particular described embodiment. The disclosed embodiment is provided only to illustrate aspects of the present invention and not in any way to limit the scope and coverage of the invention. The scope of the invention is therefore to be limited only by the appended claims.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A top hinge for a refrigerator cabinet door comprising:

a hinge body formed of plastic having a top substantially planar surface, a bottom substantially planar surface, an outer edge, and a perimeter wall extending for a height substantially perpendicularly from said bottom surface extending substantially around an entire perimeter of said hinge body defining a substantially open interior of said top hinge being enclosed by said perimeter wall, a hinge pin formed of plastic integrally with and extending substantially perpendicularly from said bottom surface of said hinge body and substantially parallel to, but beyond said height of said perimeter wall, one or more points of attachment formed on said hinge body and within said interior of said top hinge defined by said perimeter wall, an axis of twist passing through a center of said hinge pin and an effective center of attachment, and a plurality of first ribs and a plurality of second ribs extending substantially perpendicularly from said bottom surface of said hinge body within said substantially open interior, each of said ribs having at least one end in engagement with said perimeter wall along at least a portion of said height, said first ribs and said second ribs extending along a length of said bottom surface at an oblique angle relative to said axis of twist and said first ribs diverging from said second ribs by an angle of at least about 60 degrees, said first ribs being parallel to each other and said second ribs being parallel to each other.

2. A top hinge according to claim 1, wherein at least one of said first ribs and at least one of said second ribs extend through said axis of twist.

3. A top hinge according to claim 1, wherein said oblique angle is between about 30 to 60 degrees.

4. A top hinge according to claim 1, wherein said angle of divergence is between about 60 to 120 degrees.

5. A top hinge according to claim 1, wherein said perimeter wall is flush with an outer edge of said hinge body.

6. A top hinge according to claim 1, wherein said hinge body is formed of molded plastic and said hinge pin and ribs are molded integrally and simultaneously with said hinge body.

7. A top hinge according to claim 1, wherein said at least one point of attachment comprises at least one fastener opening through said hinge body.

8. A top hinge according to claim 7, wherein said fastener opening includes a boss surrounding said opening and extending from said bottom surface.

9. A top hinge according to claim 7, wherein said fastener opening includes a recess for receiving a head of a threaded fastener.

10. A top hinge according to claim 7, wherein said fastener opening comprises three fastener openings.

11. A top hinge according to claim 1, wherein said height of said perimeter wall comprises a first height along a portion of said perimeter and a second, greater height along another portion of said perimeter.

12. A top hinge according to claim 11, wherein at least one of said first ribs extends from said bottom surface for said first height and at least one of said second ribs extends from said bottom surface for said second, greater height.

13. A top hinge according to claim 12, wherein said rib with said first height is arranged at a portion of said hinge body including said hinge pin and said rib with said second height is arranged at a portion of said hinge body including said center of attachment.

14. A top hinge according to claim 1, including a longitudinal rib extending parallel to said axis of twist.

15. A top hinge according to claim 1, including a lateral rib extending perpendicular to said axis of twist.

16. A top hinge according to claim 1, wherein said hinge pin contains a blind hole oriented along an axis of said pin, said blind hole opening at a free end of said pin away from said hinge body to permit an unbroken solid top surface of said hinge body.

17. A top hinge for a refrigerator cabinet door comprising:

an elongated hinge body formed of molded plastic having a generally planar top surface, a generally planar bottom surface and a perimeter wall extending for a height substantially perpendicularly from said bottom surface and extending substantially around an entirety of a perimeter of said bottom surface defining an interior of said top hinge being enclosed by said perimeter wall, a plastic hinge pin extending substantially perpendicularly from said bottom surface, parallel to but beyond said height of said perimeter wall and being located towards one end of said hinge body, and being molded integrally and simultaneously with said hinge body, one or more points of attachment formed on said hinge body towards an opposite end of said hinge body from said hinge pin and within said interior of said top hinge defined by said perimeter wall, said points of attachment defining a geometric center of attachment, an axis of twist passing through a center of said hinge pin and said center of attachment, a plurality of first ribs parallel to each other and a plurality of second ribs parallel to each other, said ribs extending substantially perpendicularly from said bottom surface of said hinge body, with each of said ribs having at least one end in engagement with said perimeter wall along at least a portion of said height, said first ribs and said second ribs extending along a length of said bottom surface at an oblique angle relative to said axis of twist, said first ribs and said second ribs intersecting each other and diverging from each other by an angle of at least about 60 degrees, a lateral rib extending perpendicular to said axis of twist and engaging at each end with said perimeter wall and extending along at least a portion of said height, at least one of said first ribs and at least one of said second ribs engaging at one end with said lateral rib at a point on said lateral rib spaced from said perimeter wall, and a longitudinal rib extending along said axis of twist and engaging at at least one end with said perimeter wall and extending along at least a portion of said height, and having a second end, at least one of said first ribs and at least one of said second ribs intersecting with said longitudinal rib at a point on said longitudinal rib spaced from said ends of said longitudinal rib.

18. A top hinge for a refrigerator cabinet door comprising:

a hinge body formed of molded plastic having a substantially planar top surface and a substantially planar bottom surface with a perimeter wall extending for a height substantially perpendicularly from said bottom surface and extending around at least a portion of a perimeter of said bottom surface defining a substantially open interior of said top hinge being enclosed by said perimeter wall, a hinge pin extending substantially perpendicularly from said bottom surface, parallel to but beyond said height of said perimeter wall and being located at a first area of said hinge body, and being molded integrally and simultaneously with said hinge body, a plurality of points of attachment formed on said hinge body at a second area spaced from said first area and within said interior of said top hinge defined by said perimeter wall, said points of attachment defining a geometric center of attachment, an axis of twist passing through a center of said hinge pin and said center of attachment, and a plurality of first ribs parallel to each other and a plurality of second ribs parallel to each other, all extending substantially perpendicularly from said bottom surface of said hinge body within said substantially open interior and extending along a length of said bottom surface at an angle of between about 30 degrees and 60 degrees relative to said axis of twist, said first ribs and said second ribs intersecting each other and engaging at least at one end with said perimeter wall along at least a portion of said height.

19. A top hinge according to claim 18, including a lateral rib extending perpendicular to said axis of twist and engaging at each end with said perimeter wall and extending along at least a portion of said height, at least one of said first ribs and at least one of said second ribs engaging at one end with said lateral rib at a point on said lateral rib spaced from said perimeter wall.

20. A top hinge according to claim 18, including a longitudinal rib extending along said axis of twist and engaging at at least one end with said perimeter wall and extending along at least a portion of said height and having a second end, at least one of said first ribs and at least one of said second ribs intersecting with said longitudinal rib at a point on said longitudinal rib spaced from said ends of said longitudinal rib.

* * * * *